US007083178B2

(12) United States Patent
Potter

(10) Patent No.: US 7,083,178 B2
(45) Date of Patent: Aug. 1, 2006

(54) BALANCING SKATEBOARD

(76) Inventor: Steven Dickinson Potter, 114 Harnden Ave., Watertown, MA (US) 02472

( * ) Notice: Subject to any disclaimer, the term of this patent is extended or adjusted under 35 U.S.C. 154(b) by 0 days.

(21) Appl. No.: 09/832,644

(22) Filed: Apr. 11, 2001

(65) Prior Publication Data

US 2002/0149166 A1 Oct. 17, 2002

(51) Int. Cl.
*A63C 17/01* (2006.01)

(52) U.S. Cl. ..... 280/87.042; 280/87.05

(58) Field of Classification Search ..... 280/87.042, 280/87.041, 87.03, 87.021, 87.01, 842
See application file for complete search history.

(56) References Cited

U.S. PATENT DOCUMENTS 4,076,267 A * 2/1978 Lipscomb ..... 280/87.042
4,082,306 A * 4/1978 Sheldon ..... 280/87.042
4,458,907 A * 7/1984 Meredith ..... 280/87.05
4,955,626 A * 9/1990 Smith et al. ..... 280/87.042
5,160,155 A * 11/1992 Barachet ..... 280/87.042
5,458,351 A * 10/1995 Yu ..... 280/87.042
5,505,474 A * 4/1996 Yeh ..... 280/87.042
5,540,455 A * 7/1996 Chambers ..... 280/87.042
5,613,695 A * 3/1997 Yu ..... 280/887.042
5,984,328 A * 11/1999 Tipton ..... 280/87.042
6,338,494 B1 * 1/2002 Killian ..... 280/87.042
6,398,237 B1 * 6/2002 Attey ..... 280/87.042
6,428,022 B1 * 8/2002 Namiki ..... 280/87.042
2004/0262872 A1 * 12/2004 Kang ..... 280/87.042
2006/0055137 A1 * 3/2006 Jiang ..... 280/87.042

* cited by examiner

*Primary Examiner*—Jeff Restifo
(74) *Attorney, Agent, or Firm*—Fish & Richardson P.C.

(57) ABSTRACT

A skateboard for use on pavement, ice or snow using a single narrow-footprint wheel, ice-blade or ski-runner attached to each foot, thus requiring the rider to dynamically balance the board. The skateboard is capable of self-propulsion at considerable speed on the flat or uphill by using an undulating motion. It can also lean up to 30 degrees and has a steering circle of only two feet. The board's construction comprises a front footboard, a rear footboard, and a strut which connects the two footboards and resists bending and extension. Each footboard includes a footpad, an attachment (i.e. a wheel, blade or ski), and a pivot joint connecting to the strut. The axis of this joint is aligned perpendicular to the footpad which allows the rider to steer each footboard independently by torsionally rotating the lower leg.

10 Claims, 5 Drawing Sheets

FIG. 8
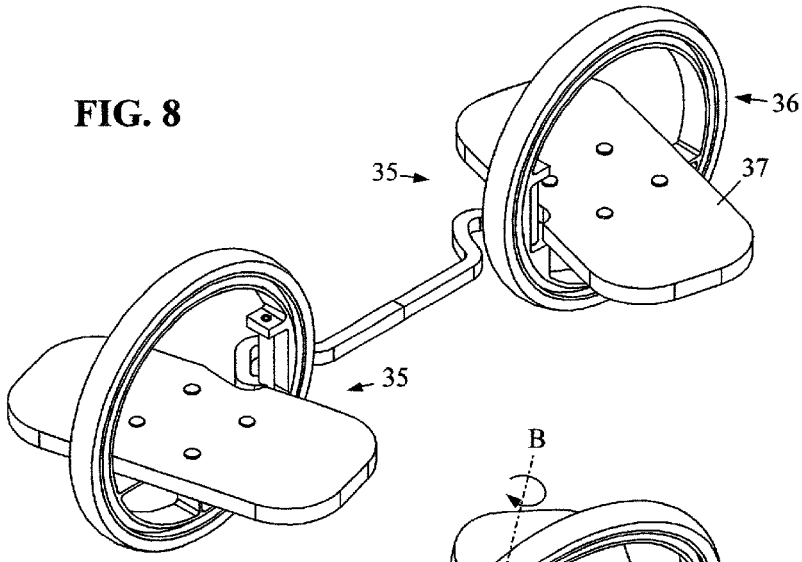
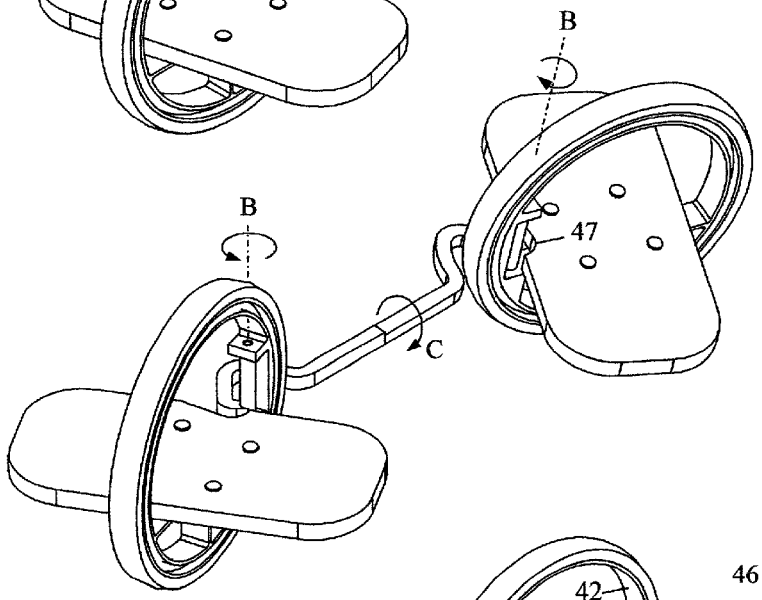
FIG. 9
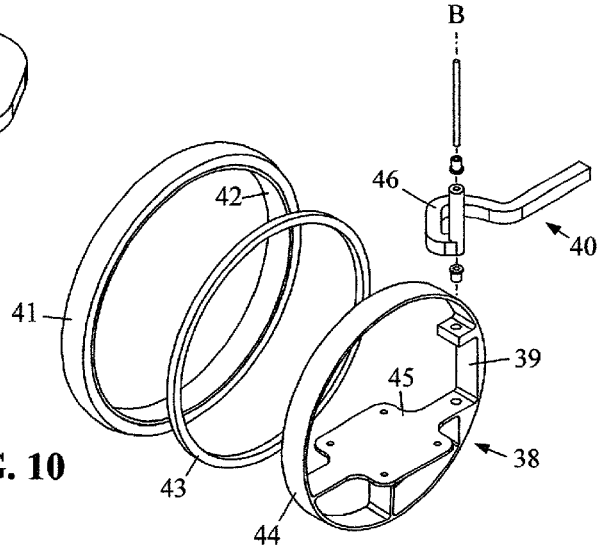
FIG. 10

FIG. 11
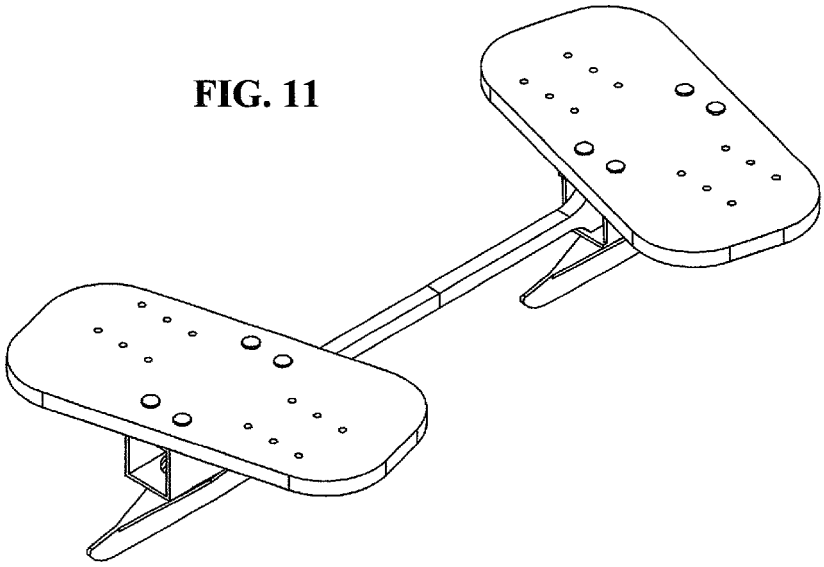
FIG. 12
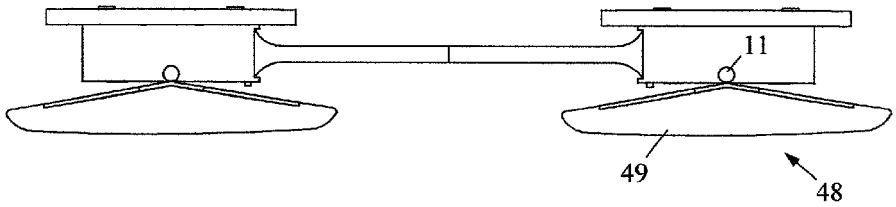
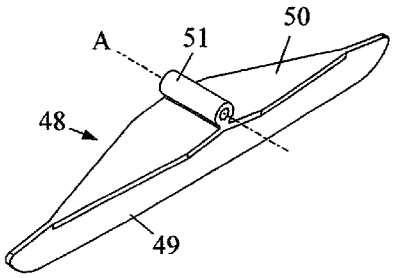
FIG. 13
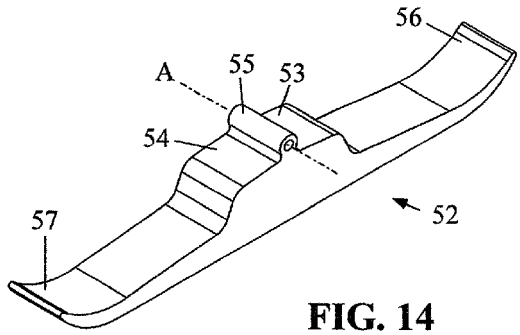
FIG. 14

BALANCING SKATEBOARD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

This invention relates to skateboards, or more generally, to devices for human locomotion involving rolling or sliding, on which the rider stands with one foot ahead of the other and controls the direction of travel by articulation of the feet.

The classic skateboard design consists of a substantially rigid board elongated in the direction of travel having two wheel-sets mounted fore and aft to the underside of the board. These two wheel-sets, which each have two coaxial wheels spaced approximately 8 inches apart, are attached to the board using skateboard "trucks" which steer the wheels in response to left/right tilting of the board. The trucks also provide a spring-effect to resist tilting.

This method of steering has three deficiencies: limited steering travel, dynamic instability, and the inability to steer the two wheel-sets independently. The first two problems are inter-related. Large steering travel could be achieved with minimal tilting, but this would exacerbate the dynamic stability. At high speeds skateboards are prone to "death-wobble" in which the board steers left and right with increasing amplitude until the rider falls.

The third deficiency, lack of fore-aft steering independence, results from the use of a rigid board. In U.S. Pat. No. 4,082,306, Sheldon discloses this solution: cut the board in half and re-connect the fore and aft portions with a torsion bar. This allows the rider to tilt the front and rear trucks independently. While this provides additional mobility, for instance the ability to crab side-ways, it offers no improvement in steering travel or minimum turning radius.

In U.S. Pat. No. 4,955,626, Smith, Fisher and King describe a radically different type of skateboard. This invention is now a market success and is commonly referred to by its trade-name: "Snakeboard". In this invention, the rider places his feet on two foot-platforms which are pivotably connected to a spacer element. The front and rear wheel-sets are positioned directly under the two foot pads, and steering is achieved by directly swiveling each foot pads about its vertical pivot axis. This arrangement provides independence of front and rear steering and a much greater range of steering angle than is practical with skateboard trucks. A key advantage of this invention is the ability to efficiently self-propel the board using a snake-like undulating motion. Since pushing off on the ground is unnecessary, the Snakeboard may be strapped to the rider's feet, which allows a range of jumps and tricks not possible with the conventional skateboard.

A significant problem with the Snakeboard is an inherent steering instability. This makes the board considerably more difficult to learn than the classic skateboard. Skateboards, snowboards, skis, surfboards and bicycles all have a tendency to steer in the direction of lean, which provides a natural self-righting effect. On a Snakeboard, however, the opposite is true.

The instability in this case is due to the outward (fore-aft) force on the two foot pads resulting from the rider's legs being spread apart. With weight balanced between toe and heel, there is no steering torque, but weighting the heels causes the outward force to be applied at the heels, resulting in a steering torque toward the toes. Similarly, weighting the toes results in a steering torque in the direction of the heels.

A second problem with the Snakeboard, as well as the classic skateboard is the sensitivity of the steering to road debris. If, for example the front right wheel hits a small pebble, the board will abruptly steer to the right.

A third problem is the trade-off between wheel diameter, height of the board and degree to which the board can be tilted. Ideally, the board should have large wheels, be as low as possible to the ground and be able to lean into a turn. With wheels mounted directly under foot, the Snakeboard cannot have large wheels and be low to the ground unless the wheels of each wheel-set are spaced very far apart. This solution adds excessive inertia about the steering axis.

The ability to lean or tilt the board provides for more natural and graceful motion and is a desirable feature for all skateboards. For this reason, the Snakeboard uses a spring-loaded tilt plate between each foot platform and wheel-set. As is also the case for the classic skateboard, additional height is required to allow the board to tilt without hitting the wheels.

Many of these problems are remedied by Barachet's two-wheel skateboard, disclosed in U.S. Pat. No. 5,160,155. This invention has a substantially rigid platform with a castering wheel in the front and a fixed wheel toward the rear. The rider stands with one foot ahead and the other behind the rear wheel. Steering of the front wheel results from tilting the board using the same principle which allows a bicycle to be ridden no-handed. While this device allows significant lean, has relatively large wheels, and is insensitive to road debris, it is less maneuverable and controllable than the Snakeboard, and is very inefficient at undulating self-propulsion. These deficiencies result from having indirect control over the front wheel, and no ability to steer the rear wheel.

With regard to skateboards for snow travel, there are several references in the prior art. In U.S. Pat. No. 5,613,695 Fu-Pin Yu describes a skateboard using Snakeboard-type steering with a single wide ski attached fore and aft in place of the two wheel-sets. This device would probably work reasonably well on fluffy snow, but on packed snow with the board tilted, turning the leading ski into the turn causes the leading edge to dig in to the snow, thus upsetting the rider. In U.S. Pat. No. 5,505,474 Hsiu-Ying Yeh presents a similar ski-board as a variation on his "folding skateboard". In this case two skis are used under each foot instead of a single wide ski but again, the steering is unstable when the board is banked in a turn. Both Yu's and Yeh's inventions have a wide footprint and thus do not have the desired challenge of having to dynamically balance the board.

BRIEF SUMMARY OF THE INVENTION

The object of this invention is to provide a skateboard which can be self-propelled without pushing off on the ground while also providing low frictional resistance, insensitivity to surface roughness, good dynamic stability, the ability to significantly tilt the board in a turn, and the challenge of balancing the board.

Of the prior art, the present invention most closely resembles the Snakeboard, the primary difference being the use of a single wheel, ice-blade or ski-runner attached to each foot-pad. This allows the foot pads to tilt much further in a turn without requiring small wheel diameter or excessive height of the board off the ground. With the wheels or runners in line with the steering axis, surface irregularities do not affect the steering. Larger diameter wheels provide lower rolling resistance and less vibration on rough roads. For full off-road capability, the foot-pads can be mounted inside large diameter pneumatic wheels using large-bore thin-style bearings.

The present invention also solves the steering instability of the Snakeboard. Since the center of foot pressure never moves significantly away from the center of the foot pad, the outward (fore-aft) force due to the legs being spread apart causes a negligible steering torque.

Lastly, the invention provides an exciting challenge in that it is not statically stable. Just as a bicycle is relatively more interesting and more graceful to ride than a tricycle, the two-wheel invention has advantage over the four-wheel Snakeboard.

For use on pavement, the preferred embodiment uses two wheels, each approximately four inches in diameter. Each wheel is mounted centrally on the underside of a foot-pad such that the direction of motion is perpendicular to the heel-toe axis of each foot-pad. The foot pads are spaced apart a distance approximately ½ the inseam leg-length of the rider by means of a strut with pivot joints at either end providing pivot axes perpendicular to the surfaces of the respective foot-pads. The strut is substantially rigid in bending so as to resist the bending moment that would otherwise cause an ankle-spraining rotation about each heel-toe axis. In torsion, the strut is relatively flexible to prevent the steering torque which would otherwise result if the rider weighted the heel of one foot and the toe of the other. Torsional flexibility is achieved using a flexure such as a thin-wall I-beam, or use of a torsional swivel joint.

The present invention is easier to learn to steer and balance than the Snakeboard, but may be more difficult to learn to self-propel. In one form of the invention, two detachable training wheels would be mounted co-axially with the primary wheel of each foot pad, and spaced apart by approximately 8 inches. Variations of the invention would provide for training wheels on just one of the two foot pads, spring loading the wheels, variable spacing, or variable height.

A partial list of additional enhancements to the invention is as follows: adjustable stops to prevent excessive rotation of the foot-pads, foot-straps to allow jumps and tricks, a dedicated boot/binding system, boots permanently attached, a wear-plate on the underside of the strut to allow "grinding" tricks, springs to align the wheels when the foot-pads are unloaded, a torsional spring in the strut to hold the two foot-pads coplanar while mounting the board, a wheel-cavity in the underside of the foot-pads to maximize the wheel diameter while minimizing overall height, suspension of the wheels to dampen vibration and road shocks, and a cable-activated hand brake.

For use on ice or snow, the wheels may be replaced by an ice-blade or snow ski runner. The use of a pivoting connection to the footpad assembly allows line contact to be maintained when the board is banked in a turn rather than having the leading edge dig in as is the case in the prior art.

BRIEF DESCRIPTION OF THE SEVERAL VIEWS OF THE DRAWING

FIG. 8 is an isometric of a skateboard suitable for rough surfaces.

FIG. 9 is an isometric of the skateboard of FIG. 8 showing the two steering axes and torsional motion of the strut.

FIG. 10 is an exploded view of the rear footboard assembly of the skateboard of FIG. 8, with the rear footpad removed.

FIG. 11 is an isometric of a skateboard adapted for use on ice.

FIG. 12 is a side elevation view of the skateboard of FIG. 11.

FIG. 13 is an isometric detail of an ice-blade from the ice skateboard shown in FIGS. 11 and 12.

FIG. 14 is an isometric of a ski-runner attachment for snow travel.

DETAILED DESCRIPTION OF THE INVENTION

The following description presents three preferred embodiments of the invention labeled I, II, III and IV for use on smooth pavement, rough surfaces, ice and snow, respectively. Additional variations and possible enhancements are also described.

Embodiment I shown in FIGS. 1–7 includes a front footboard 1, a rear footboard 2 and strut 3 which connects the two footboards. The rider stands with one foot centered over each footboard and steers by pivoting one or both feet about the two vertical steering axes B. The strut in this case serves three functions: it restrains moments about the heel-toe axes D which would otherwise cause the ankle to turn, it supplies the inward force which would otherwise require excessive exertion of the rider's inner thigh muscles, and it reduces the risk of knee injury by limiting the steering travel. To minimize unwanted steering torque it is also desirable for the two footboards to tilt independently. This is achieved by allowing torsional rotation of the strut about the axis C.

Figure 5:
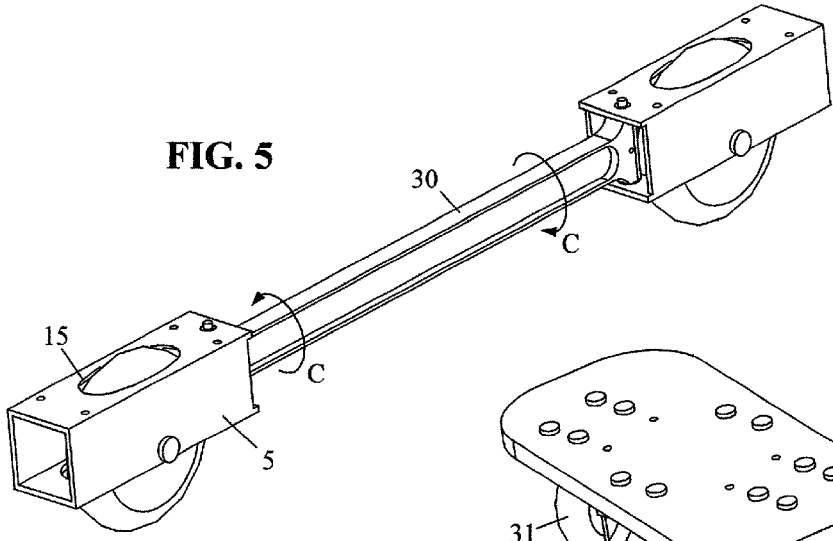
FIG. 5 is an isometric of a wheeled skateboard with footpads removed. This figure shows a second means of allowing the footpads to tilt independently, and shows how the wheels are recessed into the footpads.

The two footboards each include a footpad 4, an extruded bracket 5 and a wheel-set 6. The preferred assembly of the footboard is best seen in the exploded view of FIG. 4. The wheel-set in this case includes a wheel-body 7, internal bearing spacer 8, wheel bearings 9, outer spacers 10, wheel axle 11 and axle retaining screw 12. This construction is typical of wheels used in scooters and in-line skates. The wheel-set assembles to the bracket by inserting the wheel-body, bearings and spacers into an elongated hole 13, then inserting the wheel axle through hole 14 and locking it in place with the retaining screw. To allow the use of a large diameter wheel while avoiding excessive height of the footpads off the ground, a second elongated hole 15 is provided which allows the wheel to protrude through the top of the bracket as shown in FIG. 5. A substantially rigid and planar footpad 4 measuring approximately 5 by 12 inches attaches to the bracket using four screws 16 inserted through clearance holes 17 into threaded holes 18 on the top surface of the bracket. A relieved area on the underside of the footpad is provided to avoid interference with the wheel, and on the top, a high-friction surface is provided to minimize foot slippage.

The material of the footpad is preferably a high quality plywood, though other options include fiberglass, injection molded plastic, sheet metal, aluminum extrusion, and aluminum die-casting. As shown in the figures, the bracket is preferably made from an aluminum extrusion, but the same function could be achieved by a wide variety of processes including die-casting, injection molding, and stamping; the preferred materials being aluminum, fiber-reinforced plastic and steel, respectively.

For the rider to mount the skateboard, the preferred method is to tilt both footpads fully toward the heel edge, place both feet heel-first onto the foot-pads, then flatten both feet simultaneously and start an undulating motion. For this method to be used, the foot pads should be allowed to tilt about 30 degrees before hitting the ground. Less clearance increases the likelihood of having the footpad scrape the ground in a hard turn, and higher clearance makes the board difficult to mount.

Figure 3:
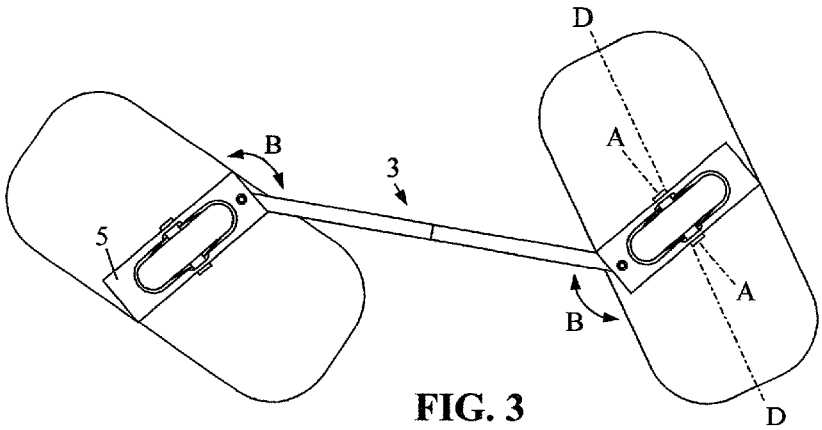
FIG. 3 is a bottom view of the skateboard of FIG. 1 showing the range of steering angle and the slight offset between the foot axis and the wheel axis.
Figure 4:
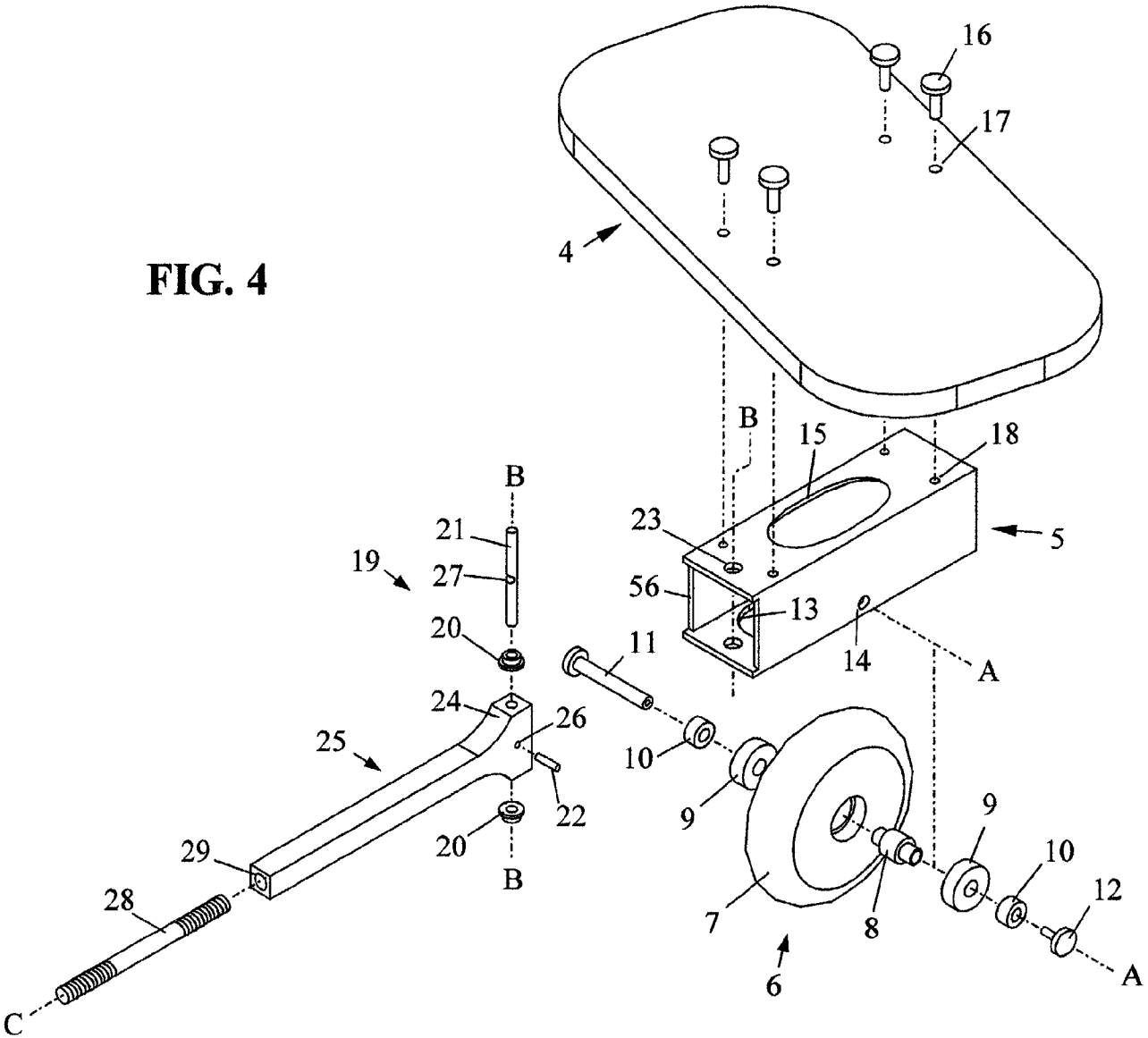
FIG. 4 is an exploded view of the front half of the skateboard of FIG. 1.

Since the average person has a slightly toe-out stance, maximum steering travel in both directions is achieved if the feet are slightly toe-out with respect to the wheel axes. This could be achieved by using a large footpad and allowing the rider to place her feet appropriately within the footpad, but to minimize weight and maximize ground clearance while tilting the board, the preferred solution is to mount each footpad such that the heel-toe axis D is toe-out approximately 15 degrees with respect to the wheel axis A, as shown in FIG. 3.

Each footboard connects to the strut by means of a pivot bearing assembly 19 which includes a pair of flange bearings 20, a pivot axle 21 and a roll pin 22. The flange bearings are inserted to the top and bottom inside surfaces of the extruded bracket at through-hole 23. The pivot-head 24 of half-strut 25 fits between the two flange bearings and is pivotably held by the pivot axle. To keep the pivot axle from falling out, the roll pin is driven into a transverse hole 26 in the pivot-head, engaging a cylindrical indent 27 in the pivot axle. The recessed sidewalls 56 of the extrusion provide a stop which restricts the rotation of the footboard to +/−50 degrees with respect to the strut.

To minimize steering torque, the pivot axis B of each footboard would ideally be in the center of the footpad. This is possible using bearings between the footpad and the wheel, but at the expense of greater height, and/or reduction in wheel diameter. Use of a single large diameter rolling-element bearing encircling the wheel is also possible, but is relatively expensive and heavy. Experiments have shown that placement of the pivot axis as shown in FIG. 3 has minimal effect on the dynamics of the skateboard. Placement of the foot with respect to the wheel axis A is far more important. If anything, the placement of the pivot axis as described has a stabilizing influence since the outward splaying force due to the rider's legs being spread tends to straighten the wheels.

Experiments have further shown that rolling element bearings are unnecessary for the pivot axes. The preferred material for the flange bearings is steel-backed Teflon, though other sliding bearing materials such as sintered bronze, Rulon, Vespel and MDS-filled Nylon could also be used.

Figure 2:
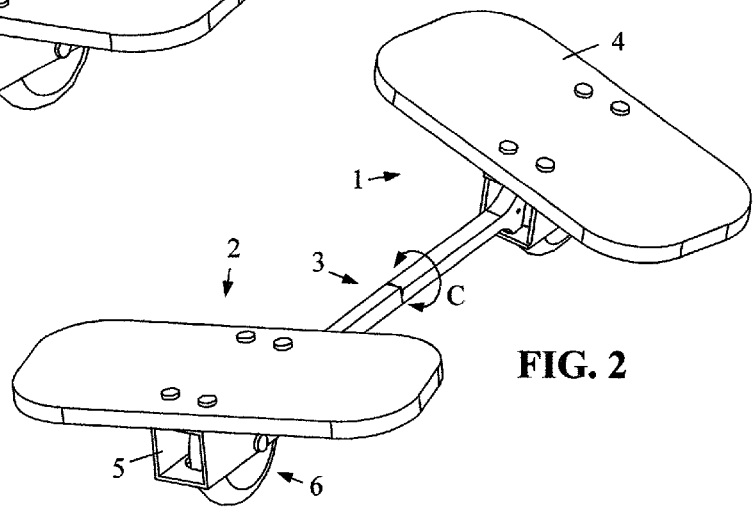
FIG. 2 is an isometric view of the skateboard of FIG. 1 demonstrating the freedom to tilt the two footpads independently.

To allow the two footboards to tilt independently, as in FIG. 2, the two half-struts are connected by the swivel-axle 28 providing torsional rotation about axis C. The swivel-axle is threaded on both ends, and each end is screwed into a countersunk, threaded hole 29 of the half-strut. Bending loads on the strut, which result from foot pressure fore or aft of the heel-toe axes D, are restrained primarily by the unthreaded shank of the swivel axle bearing on the countersunk portion of hole 29. The sliding interface is preferably lined with a low friction material such as Teflon, Nylon, Delrin or sintered bronze, or alternatively, the hole 29 of each half-strut can be loaded with a lubricant such as grease, Teflon or graphite.

Figure 6:
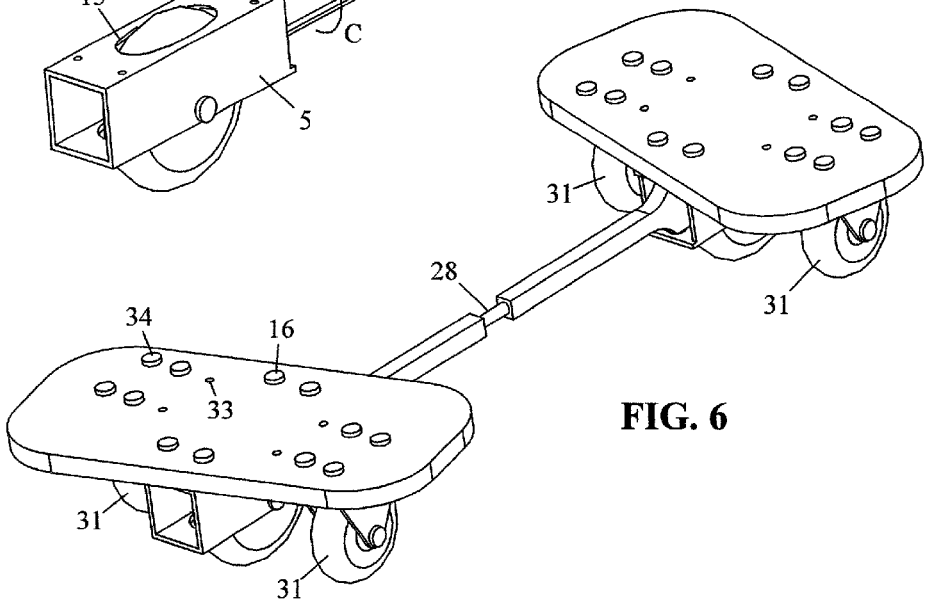
FIG. 6 is an isometric of the skateboard of FIG. 1 with training wheels added. This figure also illustrates the adjustability of the training wheels and of the strut connecting the two footpads.

A desirable feature of the invention is to provide variable spacing between the two footboards. This is conveniently achieved by screwing the swivel-axle more or less deeply into the mating holes 29 of the two half-struts, as shown in FIG. 6.

Many other methods could be used to provide a swivel joint which is stiff and strong in bending. For instance, the strut could be a 1" diameter tube with a short (~1.5") cylindrical flanged stub inserted into each end and a small-diameter threaded rod connecting the two stubs. Each stub would also have a transverse hole which would serve the same function of the pivot-head 24. By using thread-locking adhesive on the threaded rod, the strut would be a permanent assembly. The threaded rod would also act as a torsion rod providing a light spring force tending to equalize the tilt angle of the two footboards.

As shown, the strut is preferably CNC machined from an aluminum alloy such as 6061, 2024 or 7075. Other options include plastic injection molding with or without fiber reinforcement, a steel tube with welded fittings, a machined aluminum extrusion, or aluminum die-casting.

A second method of allowing the two footboards to tilt independently is to use a flexure which is stiff in bending, but relatively flexible in torsion. An example of such a flexure is the I-beam strut 30 shown in FIG. 5. Other cross-sections such as the U, C or T also provide this effect. To provide the desired torsional deflection of 10–20 degrees without excessively thin wall-thickness, it is desirable to use an engineering polymer such as Delrin, Nylon, Polycarbonate or ABS. Reinforcement with glass or other fibers may also be helpful, especially if fibers are aligned axially as in the pultrusion process.

Figure 1:
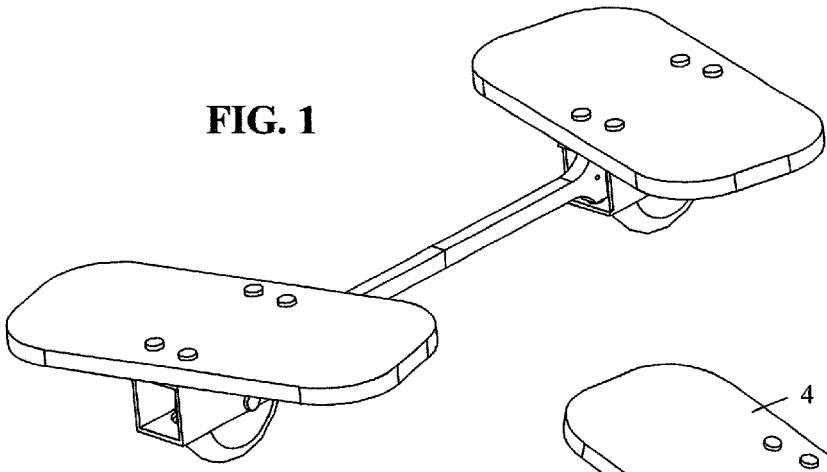
FIG. 1 is an isometric view of a wheeled skateboard for use on relatively smooth pavement.
Figure 7:
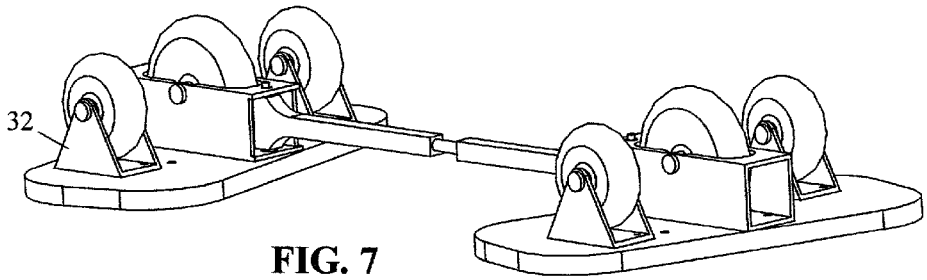
FIG. 7 is an bottom isometric of the skateboard of FIG. 6 showing the difference in height between the center wheels as compared to the training wheels.

While the skateboard of FIGS. 1–3 is easy to learn to balance and steer, it may be more difficult to learn to self-propel than the four-wheeled Snakeboard. For this reason, training wheels 31 as shown in FIGS. 6 and 7, are advantageous. These wheels would have a similar axle and bearing assembly as for the center wheel, and could be mounted using U-shaped yokes 32 to the underside of the footpads. Ideally, the training wheels are also adjustable in wheelbase, height, and stiffness with respect to the footpad. An example of wheelbase adjustment is shown in FIG. 6 wherein additional mounting holes 33 are provided in the footpad. Screws 34 pass through the holes and engage threads in the yokes. Height and stiffness are adjustable by using rubber shims of various thickness and hardness between the yokes and the footpad.

Embodiment II, shown in FIGS. 8–10, provides lower rolling resistance and a smoother ride, especially on rough or unpaved terrain. In this case each footboard 35 includes a hollow wheel 36 with diameter approximately 10 inches, a footpad 37 encircled by the wheel, and a wheel-core 38 which supports the wheel to the footpad and provides a yoke 39 to which the half-strut 40 is pivotably attached. The wheel in this case comprises a solid or pneumatic tire 41 attached to a tire-rim 42 supported by a large diameter thin-style ball-bearing 43. The inner bore of the bearing is attached to the outer rim 44 of the wheel-core. Platform 45 of the wheel-core supports the footpad and provides threaded mounting holes accepting the four footpad attachment screws.

Large, thin-style ball-bearings tend to be expensive. As an alternative, the bearing races could be stamped from sheet metal which would also serve as the tire-rim 42 and the outer rim 44 of the wheel core. A second method of reducing cost would be to use at least three smaller idler wheels supporting the tire-rim to the wheel core. In this case the tire-rim would preferably have a V-shaped rail on its inner circumference which engages a female V-shape cross-section of the idler wheels.

As in Embodiment I, Embodiment II uses a torsionally flexible or swiveling strut, however, in this case each half-strut 40 has an additional curve 46 to provide clearance for steering the wheel. A cutout 47 in each footpads is also needed to allow the desired steering travel of +/−45 to 50 degrees. With respect to the pivot and swivel axes B and C, the parts and assembly are similar to those of the first embodiment. Due to the strut's more complex geometry the preferred manufacturing method is die-casting from aluminum alloy, or injection molding of fiber-reinforced plastic, though other methods are also possible such as bending a tube and welding on the pivot-head.

Embodiment III, shown in FIGS. 11–13 is essentially the same as Embodiment I except that the two wheel-sets 6 are replaced by two ice-blades 48. Each ice-blade includes an ice-runner 49 consisting of a hard material such as steel with thickness approximately ⅛ inch, having a sharp edge or edges and curved slightly to reduce steering torque. Each rocker-blade also has a stiffening rib 50, and a mounting hole 51 which accepts the same axle 11 and axle retaining screw 12 as in Embodiment I. The stiffening rib is angled to restrict the rocking motion about axis A to approximately +/−10 degrees to avoid interference between the blade and the strut. It should be noted that the rocking motion is essential to avoid having the tip of the front blade dig into the ice if the skateboard is banked in a turn.

Fabrication of the ice-blade as shown in FIGS. 11–13 is achieved by investment casting. For higher volume production other options would be lower cost. For instance, the steel blade could be molded into a plastic part.

Embodiment IV replaces each rocker-blade with a ski-runner 52 for use on snow. As with the rocker-blade, the ski-runner attachment is interchangeable with the wheel-sets of Embodiment 1. The ski-runner has a mounting hole 55, angled surfaces 53 and 54 to limit the rocking motion, and an upturned tip 56 and tail 57 to allow travel in either direction. The ski-runner is preferably made of foam or wood coated with glass-fiber, however many other processes are appropriate including injection molding, aluminum extrusion, and die-casting. For use on hard-packed or icy snow, the use of steel edges would be advantageous. The ski-runners may also be curved or designed to flex into a curved shape to reduce steering effort.

Use of the invention is best described as it relates to Embodiment 1. In this case, the board is first set on the pavement with the heel side of the footpads resting on the ground. The rider steps heel-first onto the first footpad, and then onto the second footpad, while still weighting the heels. To initiate self propulsion to the right, the rider leans left, accelerates the upper body to the right, then rocks the footboards up onto the wheels. This provides a small initial velocity. The rider then begins an undulating motion wherein each wheel follows a substantially sinusoidal path while the rider applies greater downward and outward pressure to whichever wheel is moving away from the centerline of travel. At low speeds, this procedure looks like a shuffling motion with the two feet out of phase with each other. At higher speeds the rider can still use the shuffling motion, or can bring the two feet nearly into phase. In this mode, the rider is effectively surging up and down dynamically increasing the weight on both wheels as they steer away from the centerline, and lightening the board as it steers back to center. Other modes are also possible in which the propulsion comes primarily from the leading foot, from the trailing foot or from the torso.

Compared to the prior art, the present invention provides superior maneuverability, efficient self-propulsion, lower rolling resistance, less sensitivity to the surface irregularities, and the challenge of having to balance the board dynamically. The invention provides an excellent way to improve coordination, as well as a form of aerobic exercise.

I claim:

1. A skateboard capable of undulating self-propulsion, comprising a front footboard and a rear footboard, each of the footboards comprising a footpad, an elongated strut connecting the two footboards, the strut being rigid in bending but allowing torsional rotation, thus allowing the footboards to be tilted independently, a single wheel mounted to each footpad via a wheel-mounting bracket integral with or attached to said footpad, wherein said wheel is the principal support for said footboard with respect to the ground; and a pivot joint connecting each footpad to said strut, each pivot joint having a pivot axis substantially perpendicular to the top surface of the footpad and substantially in-line with said single wheel.

2. A skateboard of claim 1 in which the wheel is substantially centered under the footpad when the footpad is approximately parallel to the ground.

3. A skateboard of claim 1 in which small changes in the tilt angle of the footpad produce little or no restoring force, thus requiring the rider to dynamically balance the skateboard.

4. A skateboard of claim 1 in which the wheel is mounted on the underside of the footpad.

5. A skateboard of claim 1 in which the footpad of each footboard is mounted within the circumference of the wheel, said wheel being supported by a large bore bearing or by several smaller wheels engaging a circular rail, resulting in an opening sufficiently large to accept the footpad and the front half of the rider's shoe.

6. A skateboard of claim 1 in which said strut has one or more swivel-joints allowing torsional rotation while resisting bending.

7. A skateboard of claim 1 in which the initial length of the strut can be adjusted to accommodate riders of various leg lengths.

8. A skateboard of claim 1 having at least one pair of detachable training wheels mounted to at least one of the footboards, said training wheels being aligned with their axes substantially parallel to the axis of said wheel of claim 1 said training wheels being spaced apart to prevent excessive tilting of the footboard thereby allowing a beginner to more quickly learn to self-propel the skateboard.

9. A skateboard of claim 1 in which the pivot joint of each footboard allows approximately +/−45 degrees of steering travel.

10. A skateboard of claim 1 in which the footpad can tilt approximately +/−30 degrees before contacting the ground.

* * * * *